US008857123B2

(12) United States Patent
Culpepper

(10) Patent No.: US 8,857,123 B2
(45) Date of Patent: Oct. 14, 2014

(54) FOAM INSULATION BOARD

(71) Applicant: Patrick M. Culpepper, Massillon, OH (US)

(72) Inventor: Patrick M. Culpepper, Massillon, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 0 days.

(21) Appl. No.: 13/896,780

(22) Filed: May 17, 2013

(65) Prior Publication Data

US 2013/0247493 A1 Sep. 26, 2013

Related U.S. Application Data

(60) Continuation-in-part of application No. 12/817,313, filed on Jun. 17, 2010, which is a division of application No. 11/025,623, filed on Dec. 29, 2004, now Pat. No. 7,762,040, and a continuation-in-part of application No. 13/241,949, filed on Sep. 23, 2011, which is a continuation-in-part of application No. 12/817,313, filed on Jun. 17, 2010, said application No. 13/896,780 is a continuation-in-part of application No. 13/241,684, filed on Sep. 23, 2011, which is a continuation-in-part of application No. 12/817,313, filed on Jun. 17, 2010.

(60) Provisional application No. 60/600,845, filed on Aug. 12, 2004.

(51) Int. Cl.

| | |
|---|---|
| ***E04C 2/20*** | (2006.01) |
| ***E04F 13/08*** | (2006.01) |
| ***E04F 13/14*** | (2006.01) |
| *E04F 13/12* | (2006.01) |
| *E04B 1/68* | (2006.01) |
| *E04F 13/072* | (2006.01) |
| *E04F 13/078* | (2006.01) |

(52) U.S. Cl.

CPC ..... *E04F 13/0864* (2013.01); *E04F 13/12* (2013.01); *E04B 1/68* (2013.01); *E04F 13/072* (2013.01); *E04F 13/078* (2013.01); *E04F 13/141* (2013.01)

USPC ..... 52/533; 52/302.1; 52/535; 52/309.7

(58) Field of Classification Search

CPC ..... E04B 1/70; E04B 1/68; E04B 1/64; E04F 13/075; E04F 13/12; E04F 13/07; E04F 13/072; E04F 13/078; E04C 2/20; E04C 2/52

USPC ..... 52/302.3, 533, 302.1, 519, 520, 534, 52/543, 556, 545, 105

See application file for complete search history.

(56) References Cited

U.S. PATENT DOCUMENTS 1,159,766 A * 11/1915 Heppes ..... 52/519
1,266,137 A * 5/1918 Melde ..... 52/533

(Continued)

*Primary Examiner* — Phi A

(74) *Attorney, Agent, or Firm* — Richard M. Klein; Fay Sharpe LLP

(57) ABSTRACT

Disclosed herein are embodiments of foam backing panels for use with lap siding and configured for mounting on a building. Also disclosed are lap siding assemblies and products of lap sidings. One such embodiment of the foam backing panel comprises a rear face configured to contact the building, a flat front face configured for attachment to the lap siding, alignment means for aligning the lap siding relative to the building, means for providing a shadow line, opposing vertical side faces, a top face extending between a top edge of the front face and rear face and a bottom face extending between a bottom edge of the front face and rear face.

14 Claims, 14 Drawing Sheets

(56) References Cited

U.S. PATENT DOCUMENTS

| | | | | | |
|---|---|---|---|---|---|
| 3,034,261 | A | * | 5/1962 | Hollmann et al. | 52/553 |
| 3,583,118 | A | * | 6/1971 | Lowery | 52/309.5 |
| 4,244,761 | A | * | 1/1981 | Remi et al. | 156/71 |
| 4,320,613 | A | * | 3/1982 | Kaufman | 52/521 |
| 4,463,533 | A | * | 8/1984 | Mullet | 52/394 |
| 4,492,064 | A | * | 1/1985 | Bynoe | 52/309.8 |
| 4,686,803 | A | * | 8/1987 | Couderc et al. | 52/97 |
| 4,788,808 | A | * | 12/1988 | Slocum | 52/521 |
| 5,056,281 | A | * | 10/1991 | McCarthy | 52/169.5 |
| 5,209,037 | A | * | 5/1993 | Kennedy et al. | 52/309.12 |
| 5,502,940 | A | * | 4/1996 | Fifield | 52/309.12 |
| 6,594,965 | B2 | * | 7/2003 | Coulton | 52/302.1 |
| 7,325,325 | B2 | * | 2/2008 | Gleeson | 33/563 |
| 7,575,701 | B2 | * | 8/2009 | Waggoner et al. | 264/154 |

* cited by examiner

FOAM INSULATION BOARD

CROSS REFERENCE TO RELATED APPLICATIONS

This application is a continuation-in-part of U.S. patent application Ser. No. 12/817,313, filed on Jun. 17, 2010, which is a divisional of U.S. patent application Ser. No. 11/025,623, filed on Dec. 29, 2004, now U.S. Pat. No. 7,762,040, which claimed priority to U.S. Provisional Patent Application Ser. No. 60/600,845 filed on Aug. 12, 2004. This application is also a continuation-in-part of U.S. patent application Ser. No. 13/241,949, filed on Sep. 23, 2011, which is a continuation-in-part of U.S. patent application Ser. No. 12/817,313, filed on Jun. 17, 2010, which is a divisional of U.S. patent application Ser. No. 11/025,623, filed on Dec. 29, 2004, now U.S. Pat. No. 7,762,040, which claimed priority to U.S. Provisional Patent Application Ser. No. 60/600,845 filed on Aug. 12, 2004. This application is also a continuation-in-part of U.S. patent application Ser. No. 13/241,684, filed on Sep. 23, 2011, which is a continuation-in-part of U.S. patent application Ser. No. 12/817,313, filed on Jun. 17, 2010, which is a divisional of U.S. patent application Ser. No. 11/025,623, filed on Dec. 29, 2004, now U.S. Pat. No. 7,762,040, which claimed priority to U. S. Provisional Patent Application Ser. No. 60/600,845 filed on Aug. 12, 2004. The disclosures of these applications are hereby fully incorporated by reference in their entirety.

FIELD OF THE INVENTION

The invention is related to an insulated fiber cement siding.

BACKGROUND OF THE INVENTION

A new category of lap siding, made from fiber cement or composite wood materials, has been introduced into the residential and light commercial siding market during the past ten or more years. It has replaced a large portion of the wafer board siding market, which has been devastated by huge warranty claims and lawsuits resulting from delamination and surface irregularity problems.

Fiber cement siding has a number of excellent attributes which are derived from its fiber cement base. Painted fiber cement looks and feels like wood. It is strong and has good impact resistance and it will not rot. It has a Class 1(A) fire rating and requires less frequent painting than wood siding. It will withstand termite attacks. Similarly composite wood siding has many advantages.

Fiber cement is available in at least 16 different faces that range in exposures from 4 inches to 10.75 inches. The panels are approximately 5/16 inch thick and are generally 12 feet in length. They are packaged for shipment and storage in units that weigh roughly 5,000 pounds.

Fiber cement panels are much heavier than wood and are hard to cut requiring diamond tipped saw blades or a mechanical shear. Composite wood siding can also be difficult to work with. For example, a standard 12 foot length of the most popular 8¼ inch fiber cement lap siding weighs 20.6 pounds per piece. Moreover, installers report that it is both difficult and time consuming to install. Fiber cement lap siding panels, as well as wood composite siding panels, are installed starting at the bottom of a wall. The first course is positioned with a starter strip and is then blind nailed in the 1¼ inch high overlap area at the top of the panel (see FIG. 1). The next panel is installed so that the bottom 1¼ inch overlaps the piece that it is covering. This overlap is maintained on each successive course to give the siding the desired lapped siding appearance. The relative height of each panel must be meticulously measured and aligned before the panel can be fastened to each subsequent panel. If any panel is installed incorrectly the entire wall will thereafter be miss-spaced.

Current fiber cement lap siding has a very shallow 5/16 inch shadow line. The shadow line, in the case of this siding, is dictated by the 5/16 inch base material thickness. In recent years, to satisfy customer demand for the impressive appearance that is afforded by more attractive and dramatic shadow lines virtually all residential siding manufacturers have gradually increased their shadow lines from ½ inch and ⅝ inch to ¾ inch and 1 inch.

SUMMARY OF THE INVENTION

Disclosed herein are embodiments of foam backing panels for use with lap siding and configured for mounting on a building. One such embodiment of the foam backing panel comprises a rear face configured to contact the building, a front face configured for attachment to the lap siding, alignment means for aligning the lap siding relative to the building, means for providing a shadow line, opposing vertical side edges, a top face extending between a top edge of the front face and rear face and a bottom face extending between a bottom edge of the front face and rear face.

Also disclosed herein are embodiments of siding panel assemblies. One such assembly comprises the foam backing panel described above, with the alignment means comprising alignment ribs extending a width of the front face, the alignment ribs spaced equidistant from the bottom edge to the top edge of the front face. A plurality of siding panels is configured to attach to the foam backing panel, each siding panel having a top face and a bottom face, the top face configured to align with one of the alignment ribs such that the bottom face extends beyond an adjacent alignment rib.

Also disclosed herein are methods of making the backing and siding panel. One such method comprises providing a siding panel and joining a porous, closed cell foam to a substantial portion of a major surface of the fiber cement substrate, the foam providing a drainage path through cells throughout the foam.

Also disclosed in embodiments is a foam insulation board comprising: a front face and a rear face; a first side face and a second side face; and a top face and a bottom face. The top face includes a top joining element, and the bottom face includes a bottom joining element complementary in shape to the top joining element. The first side face includes a first joining element, and the second side face includes a second joining element complementary in shape to the first joining element. An adhesive is present on at least one face of the top joining element, the bottom joining element, the first joining element, or the second joining element.

Several specific embodiments are contemplated. In one embodiment, the top joining element is a tongue, and the one face with the adhesive is a front face of the tongue. In another embodiment, the top joining element is a tongue, and the one face with the adhesive is an upper face of the tongue. In a different embodiment, the bottom joining element is a groove, and the one face with the adhesive is a rear face of the groove. In another embodiment, the bottom joining element is a groove, and the one face with the adhesive is a lower face of the groove. In the next embodiment, the second joining element is a tongue, and the one face with the adhesive is a front face of the tongue. In another embodiment, the second joining element is a tongue, and the one face with the adhesive is a sideward face of the tongue. In still another embodiment, the first joining element is a groove, and the one face with the adhesive is a rear face of the groove. In a final embodiment, the first joining element is a groove, and the one face with the adhesive is a sideward face of the groove.

In some general embodiments, the one face with the adhesive is a front face of the joining element. In other general embodiments, the one face with the adhesive is a rear face of the joining element. In still some other embodiments, the one face with the adhesive is a sideward face of the joining element.

The adhesive may be covered with a pull-off strip. The adhesive may be a UV curable adhesive, a hot melt adhesive, a thermosetting or thermoplastic adhesive, a pressure sensitive adhesive, or a solvent-based adhesive.

The rear face of the foam board may further comprise drainage grooves. The foam insulation board may be made of expanded polystyrene. The foam insulation board may further comprise a plurality of registration ribs positioned longitudinally across the front face and spaced equidistantly.

Also disclosed herein are embodiments of foam backing panels that have alternating high density portions and low density portions. Fasteners used to attach the foam back panel to an exterior wall pass through the high density portions.

Also discussed herein are insulation systems that include a starter strip. The insulation system also includes (i) a foam backing board and a siding panel; or (ii) a composite panel made from a foam backer and a siding panel. The starter strip includes a channel adapted to receive the bottom face of the foam backing board or foam backer. The siding panel is sized to hide the starter strip when the foam backing board or foam backer is placed in the channel of the starter strip.

BRIEF DESCRIPTION OF THE DRAWINGS

The description herein makes reference to the accompanying drawings wherein like reference numerals refer to like parts throughout the several views, and wherein.

DETAILED DESCRIPTION

The invention outlined hereinafter addresses the concerns of the aforementioned shortcomings or limitations of current fiber cement siding 10.

Figure 1:
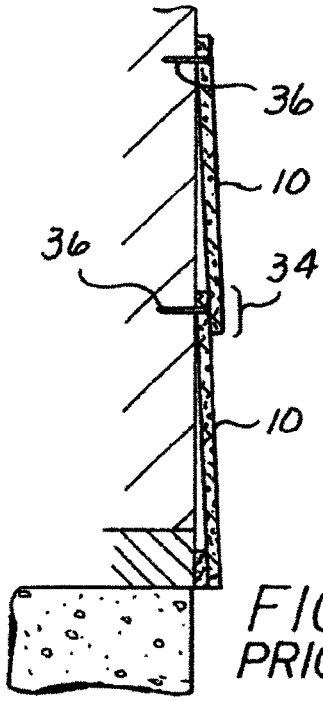
FIG. 1 PRIOR ART
FIG. 1 is a sectional view of a prior art fiber cement panel installation.
Figure 2A:
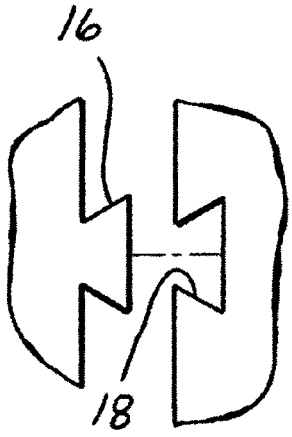
FIG. 2*a* is a portion of the installation board shown in FIG. 2 featuring interlocking tabs.
Figure 2:
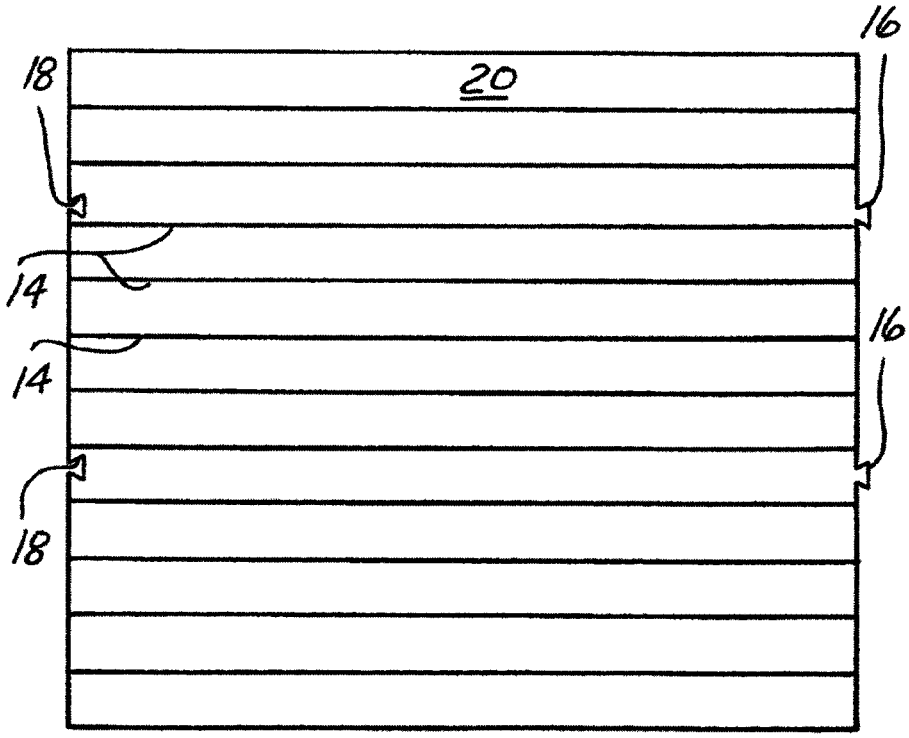
FIG. 2 is a plan view of a contoured alignment installation board according to a first preferred embodiment of the present invention.

A shape molded, extruded or wire cut foam board 12 has been developed to serve as a combination installation/alignment tool and an insulation board. This rectangular board 12, shown in FIG. 2 is designed to work with 1¼ inch trim accessories. The board's 12 exterior dimensions will vary depending upon the profile it has been designed to incorporate, see FIG. 3.

With reference to FIG. 2 there is shown a plan view of a contoured foam alignment backer utilized with the installation method of the first preferred embodiment. Installation and alignment foam board 12 includes a plurality or registration of alignment ribs 14 positioned longitudinally across board 12. Alignment board 12 further includes interlocking tabs 16 which interlock into grooves or slots 18. As illustrated in FIG. 2*a*, and in the preferred embodiment, this construction is a dovetail arrangement 16, 18. It is understood that the dovetail arrangement could be used with any type of siding product, including composite siding and the like where it is beneficial to attach adjacent foam panels.

Typical fiber cement lap siding panels 10 are available in 12 foot lengths and heights ranging from 5¼ inches to 12 inches. However, the foam boards 12 are designed specifically for a given profile height and face such as, Dutch lap, flat, beaded, etc. Each foam board 12 generally is designed to incorporate between four and twelve courses of a given fiber cement lap siding 10. Spacing between alignment ribs 14 may vary dependent upon a particular fiber cement siding panel 10 being used. Further size changes will naturally come with market requirements. Various materials may also be substituted for the fiber cement lap siding panels 10.

One commercially available material is an engineered wood product coated with special binders to add strength and moisture resistance; and further treated with a zinc borate-based treatment to resist fungal decay and termites. This product is available under the name of LP SmartSide® manufactured by LP Specialty Products, a unit of Louisiana-Pacific Corporation (LP) headquartered in Nashville, Tenn. Other substituted materials may include a combination of cellulose, wood and a plastic, such as polyethylene. Therefore, although this invention is discussed with and is primarily beneficial for use with fiber board, the invention is also applicable with the aforementioned substitutes and other alternative materials such as vinyl and rubber.

Figure 3:
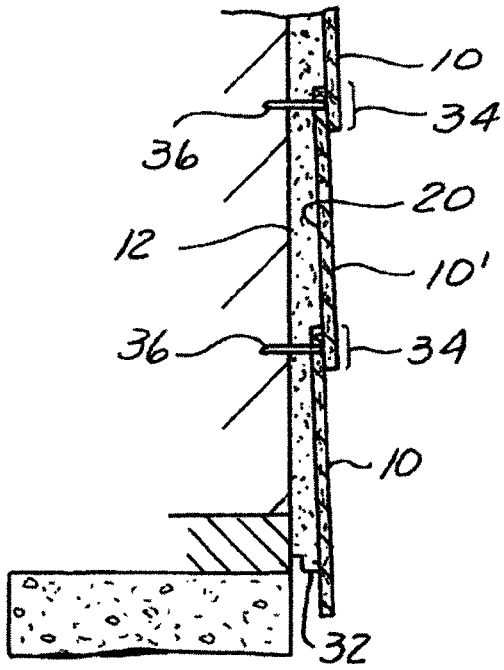
FIG. 3 is a sectional view of a fiber cement or wood composite installation using a first preferred method of installation.
Figure 4:
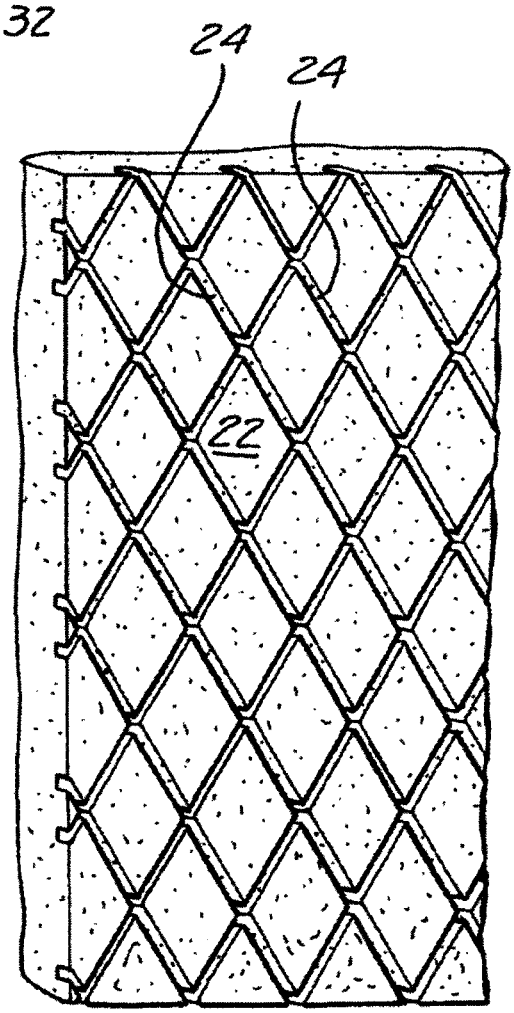
FIG. 4 is a rear perspective view of the installation board of FIG. 2.

The foam boards 12 incorporate a contour cut alignment configuration on the front side 20, as shown in FIG. 3. The back side 22 is flat to support it against the wall, as shown in FIG. 4. The flat side 22 of the board, FIG. 4, will likely incorporate a drainage plane system 24 to assist in directing moisture runoff, if moisture finds its way into the wall 12. It should be noted that moisture in the form of vapor, will pass through the foam from the warm side to the cold side with changes in temperature. The drainage plane system is incorporated by reference as disclosed in application Ser. No. 60/511,527 filed on Oct. 15, 2003.

To install the fiber cement siding, according to the present invention, the installer must first establish a chalk line 26 at the bottom of the wall 28 of the building to serve as a straight reference line to position the foam board 12 for the first course 15 of foam board 12, following siding manufacturer's instructions.

Figure 5:
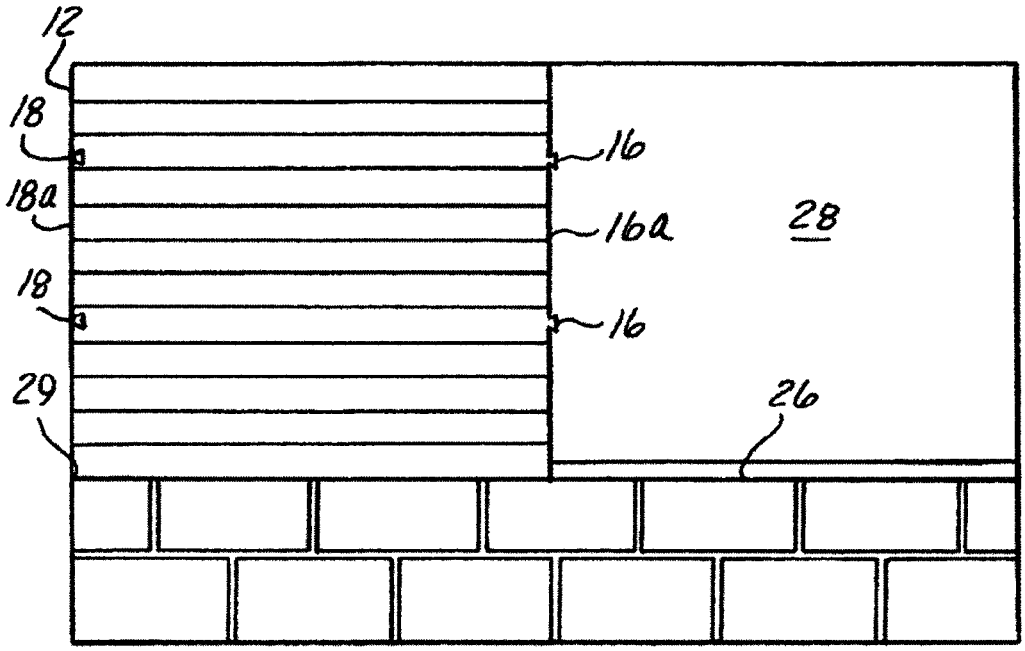
FIG. 5 is a plan view of an installation board according to a first preferred embodiment of the present invention attached to a wall.
Figure 6:
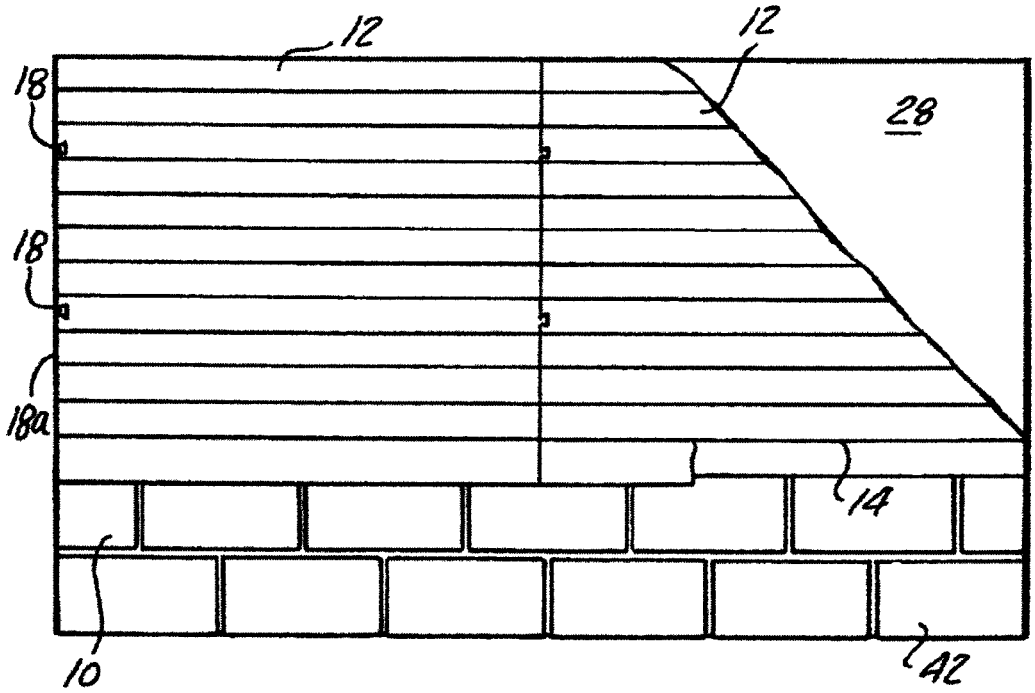
FIG. 6 is a plan view of an installation board on a wall.
Figure 7:
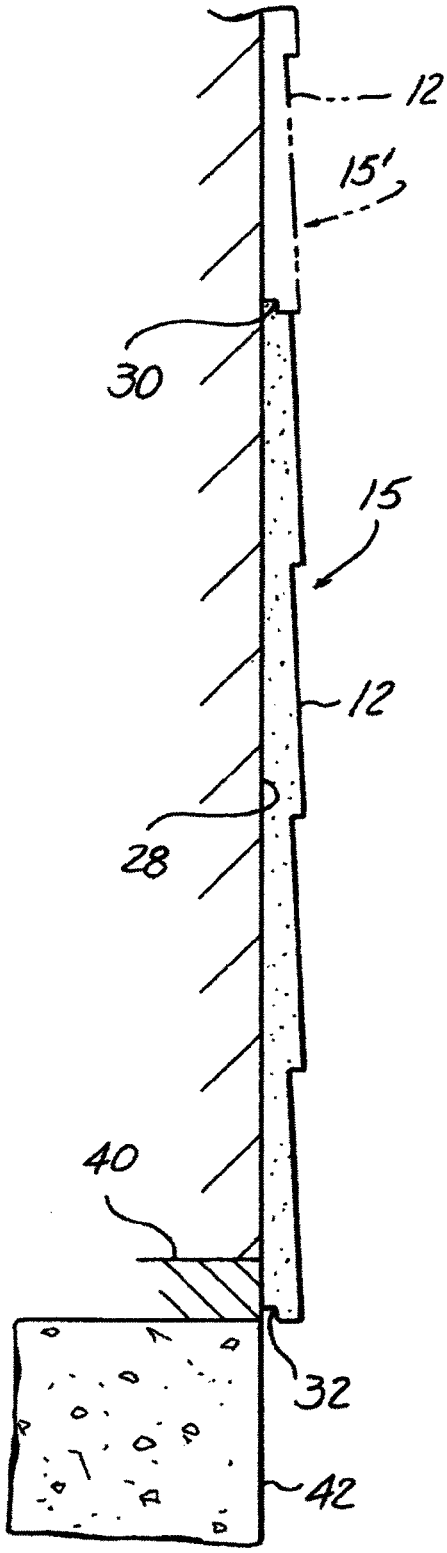
FIG. 7 is a sectional view of the installation board illustrating the feature of a ship lap utilized to attach multiple EPS foam backers or other foam material backers when practicing the method of the first preferred embodiment of the present invention.
Figure 7A:
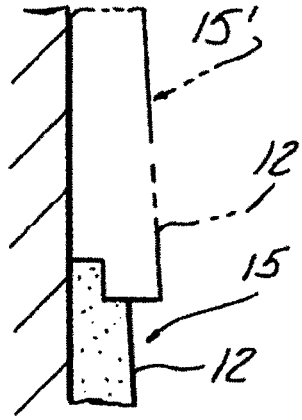
FIG. 7*a* is a sectional view of an upper ship lap joint.
Figure 7B:
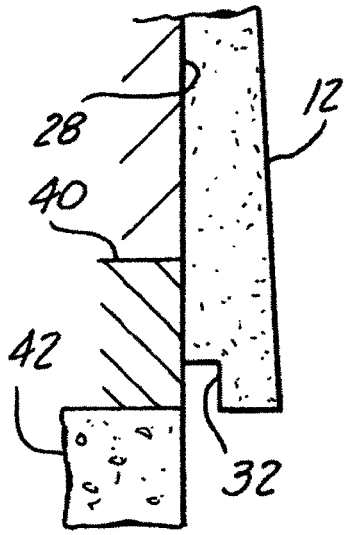
FIG. 7*b* is a sectional view of a lower ship lap joint.

The foam boards 12 are designed to be installed or mated tightly next to each other on the wall 28, both horizontally and vertically. The first course foam boards 12 are to be laid along the chalk line 26 beginning at the bottom corner of an exterior wall 28 of the building (as shown FIG. 5) and tacked into position. When installed correctly, this grid formation provided will help insure the proper spacing and alignment of each piece of lap siding 10. As shown in FIGS. 5 and 6, the vertical edges 16*a*, 18*a* of each foam board 12 are fabricated with an interlocking tab 16 and slot 18 mechanism that insure proper height alignment. Ensuring that the tabs 16 are fully interlocked and seated in the slots 18, provides proper alignment of the cement lap siding. As shown in FIGS. 7, 7*a*, 7*b*, the horizontal edges 30, 32 incorporate ship-lapped edges 30, 32 that allow both top and bottom foam boards 12 to mate tightly together. The foam boards 12 are also designed to provide proper horizontal spacing and alignment up the wall 28 from one course to the next, as shown in phantom in FIGS. 7 and 7*a*.

As the exterior wall 28 is covered with foam boards 12, it may be necessary to cut and fit the foam boards 12 as they mate next to doorways, windows, gable corners, electrical outlets, water faucets, etc. This cutting and fitting can be accomplished using a circular saw, a razor knife or a hot knife. The opening (not shown) should be set back no more than ⅛ inches for foundation settling.

Once the first course 15 has been installed, the second course 15' of foam boards 12 can be installed at any time. The entire first course 15 on any given wall should be covered before the second course 15' is installed. It is important to insure that each foam board 12 is fully interlocked and seated on the interlocking tabs 16 to achieve correct alignment.

The first piece of fiber cement lap siding 10 is installed on the first course 15 of the foam board 12 and moved to a position approximately ⅛ inches set back from the corner and pushed up against the foam board registration or alignment rib 14 (see FIG. 8) to maintain proper positioning of the panel 10. The foam board registration or alignment rib 14 is used to align and space each fiber cement panel 10 properly as the siding job progresses. Unlike installing the fiber cement lap siding in the prior art, there is no need to measure the panel's relative face height to insure proper alignment. All the system mechanics have been accounted for in the rib 14 location on the foam board 12. The applicator simply places the panel 10 in position and pushes it tightly up against the foam board alignment rib 14 immediately prior to fastening. A second piece of fiber cement lap siding can be butted tightly to the first, pushed up against the registration or alignment rib and fastened securely with fasteners 17 with either a nail gun or hammer. Because the alignment ribs 14 are preformed and pre-measured to correspond to the appropriate overlap 30 between adjacent fiber cement siding panels 10, no measurement is required. Further, because the alignment ribs 14 are level with respect to one another, an installer need not perform the meticulous leveling tasks associated with the prior art methods of installation.

With reference to FIGS. 7, 7*a*, 7*b*, vertically aligned boards 20 include a ship lap 30, 32 mating arrangement which provides for a continuous foam surface. Furthermore, the interlocking tabs 16, 18 together with the ship lap 30, 32 ensures that adjacent fiber boards 12, whether they be vertically adjacent or horizontally adjacent, may be tightly and precisely mated together such that no further measurement or alignment is required to maintain appropriate spacing between adjacent boards 12. It is understood that as boards 12 are mounted and attached to one another it may be necessary to trim such boards when windows, corners, electrical outlets, water faucets, etc. are encountered. These cuts can be made with a circular saw, razor knife, or hot knife.

Thereafter, a second course of fiber cement siding 10' can be installed above the first course 10 by simply repeating the steps and without the need for leveling or measuring operation. When fully seated up against the foam board alignment rib 14, the fiber cement panel 10' will project down over the first course 10 to overlap 34 by a desired 1¼ inches, as built into the system as shown in FIG. 3. The next course is fastened against wall 28 using fasteners 36 as previously described. The foam board 12 must be fully and properly placed under all of the fiber cement panels 10. The installer should not attempt to fasten the fiber cement siding 10 in an area that it is not seated on and protected by a foam board 12.

The board 12, described above, will be fabricated from foam at a thickness of approximately 1¼ inch peak height. Depending on the siding profile, the board 12 should offer a system "R" value of 3.5 to 4.0. This addition is dramatic considering that the average home constructed in the 1960's has an "R" value of 8. An R-19 side wall is thought to be the optimum in thermal efficiency. The use of the foam board will provide a building that is cooler in the summer and warmer in the winter. The use of the foam board 12 of the present invention also increases thermal efficiency, decreases drafts and provides added comfort to a home.

Figure 9:
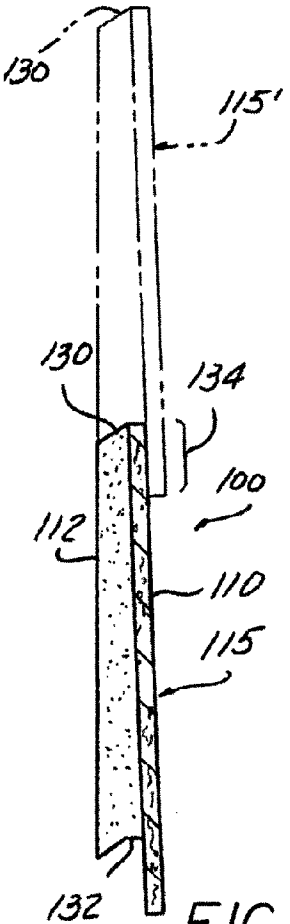
FIG. 9 is a second preferred embodiment of a method to install a fiber cement panel.

In an alternate embodiment, a family of insulated fiber cement lap siding panels 100 has been developed, as shown in FIG. 9, in the interest of solving several limitations associated with present fiber cement lap sidings. These composite panels 100 incorporate a foam backer 112 that has been bonded or laminated to a complementary fiber cement lap siding panel 110. Foam backing 112 preferably includes an angled portion 130 and a complementary angled portion 132 to allow multiple courses of composite fiber cement siding panels 100 to be adjoined. Foam backer 112 is positioned against fiber cement siding 110 in such a manner as to leave an overlap region 134 which will provide for an overlap of siding panels on installation.

The fiber cement composite siding panels 100 of the second preferred embodiment may be formed by providing appropriately configured foam backing pieces 132 which may be adhesively attached to the fiber cement siding panel 110.

Figure 10C:
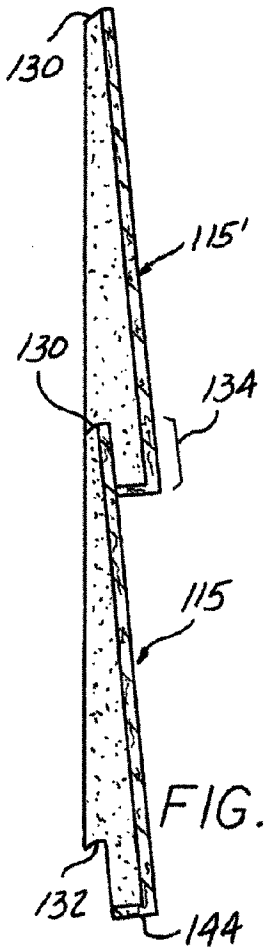
FIG. 10*c* shows the cement board in FIG. 8*d* installed over an installation board of the present invention.
Figure 10B:
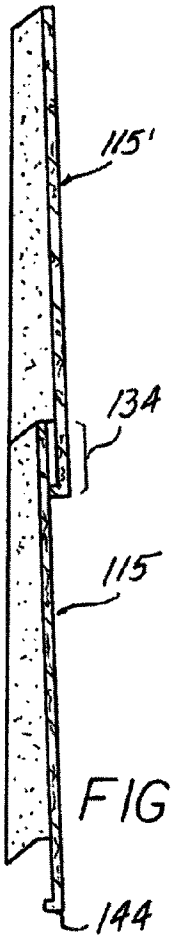
FIG. 10*b* shows the cement board in FIG. 8*c* installed over an installation board of the present invention.
Figure 13:
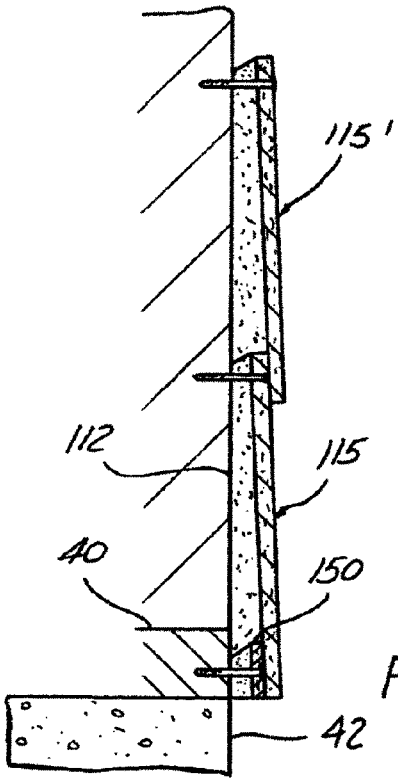
FIG. 13 illustrates a method for installing a first and second layer of fiber cement or wood composite panels.

The composite siding panels 100 according to the second preferred embodiment may be installed as follows with reference to FIGS. 10*b*, 10*c* and 13. A first course 115 is aligned appropriately against sill plate 40 adjacent to the foundation 42 to be level and is fastened into place with fasteners 36. Thereafter, adjacent courses 115' may be merely rested upon the previous installed course and fastened into place. The complementary nature of angled portions 130, 132 will create a substantially uniformed and sealed foam barrier behind composite siding panels 100. Overlap 134, which has been pre-measured in relation to the foam pieces, allows multiple courses to be installed without the need for measuring or further alignment. This dramatic new siding of the present invention combines an insulation component with an automatic self-aligning, stack-on siding design. The foam backer 112 provides a system "R" value in the range of 3.5 to 4.0. The foam backer 112 will also be fabricated from expanded polystyrene (EPS), which has been treated with a chemical additive to deter termites and carpenter ants.

The new self-aligning, stack-on siding design of the present invention provides fast, reliable alignment, as compared to the time consuming, repeated face measuring and alignment required on each course with the present lap design.

Figure 8A:
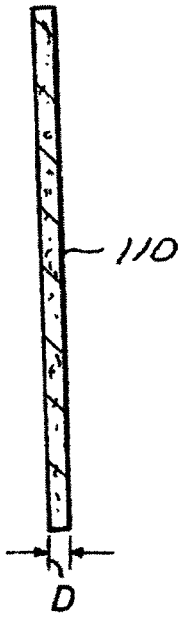
FIG. 8A PRIOR ART
FIG. 8*a* is a sectional view of the fiber cement board of the prior art panel.
Figure 8B:
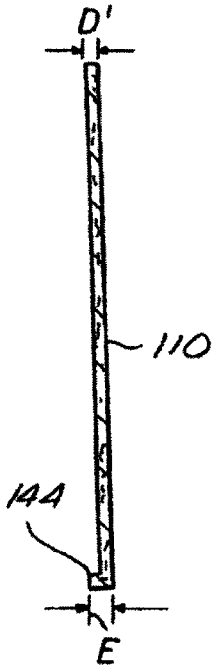
FIGS. 8*b*-8*d* are sectional views of fiber cement boards having various sized shadow lines.
Figure 8C:
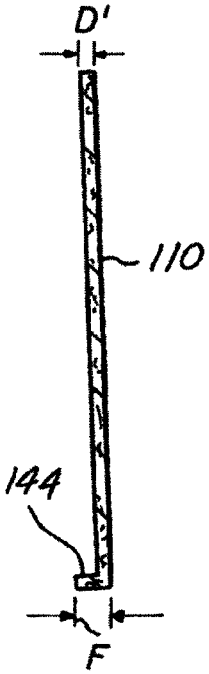

The new foam backer 112 has significant flexural and compressive strength. The fiber cement siding manufacturer can reasonably take advantage of these attributes. The weight of the fiber cement siding 110 can be dramatically reduced by thinning, redesigning and shaping some of the profiles of the fiber cement 110. FIG. 8*a* shows the current dimensions of fiber cement boards, FIGS. 8*b*, 8*c*, and 8*c* show thinner fiber cement board. Experience with other laminated siding products has shown that dramatic reductions in the base material can be made without adversely affecting the product's performance. The combination of weight reduction with the new stack-on design provides the installers with answers to their major objections. It is conceivable that the present thickness (D') of fiber cement lap siding panels 110 of approximately 0.313 inches could be reduced to a thickness (D') of 0.125 inches or less.

The fiber cement siding panel may include a lip 144 which, when mated to another course of similarly configured composite fiber cement siding can give the fiber cement siding 110 the appearance of being much thicker thus achieving an appearance of an increased shadow line. Further, it is understood although not required, that the fiber cement siding panel 110 may be of substantially reduced thickness, as stated supra, compared to the 5/16" thickness provided by the prior art. Reducing the thickness of the fiber cement siding panel 110 yields a substantially lighter product, thereby making it far easier to install. A pair of installed fiber cement composite panels having a thickness (D') of 0.125 or less is illustrated in FIGS. 8B-8D and 10B and 10C. Such installation is carried out in similar fashion as that described in the second preferred embodiment.

Figure 8D:
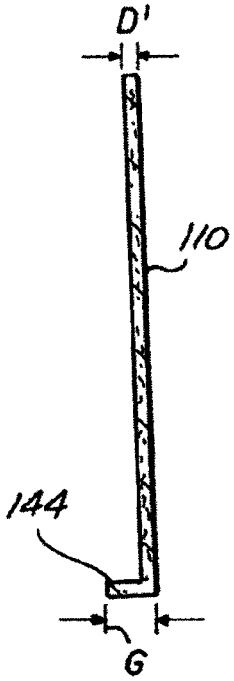
Figure 10A:
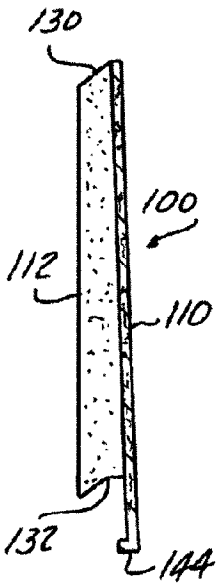
FIG. 10*a* shows the cement board in FIG. 8*b* installed over an installation board of the present invention.

The present invention provides for an alternate arrangement of foam 112 supporting the novel configuration of fiber cement paneling. In particular, the foam may include an undercut recess 132 which is configured to accommodate an adjacent piece of foam siding. As shown in FIGS. 10*a*, 10*b* and 10*c*, the new, thinner, insulated fiber cement lap siding panel 110 will allow the siding manufacturers to market panels with virtually any desirable shadow line, such as the popular new ¾ inch vinyl siding shadow line with the lip 144 formation. The lip 144 can have various lengths such as approximately 0.313 inch (E), 0.50 inch (F), and 0.75 (G) inch to illustrate a few variations as shown in FIGS. 8*b*, 8*c*, and 8*d*, respectively. This new attribute would offer an extremely valuable, previously unattainable, selling feature that is simply beyond the reach with the current system.

Figure 11:
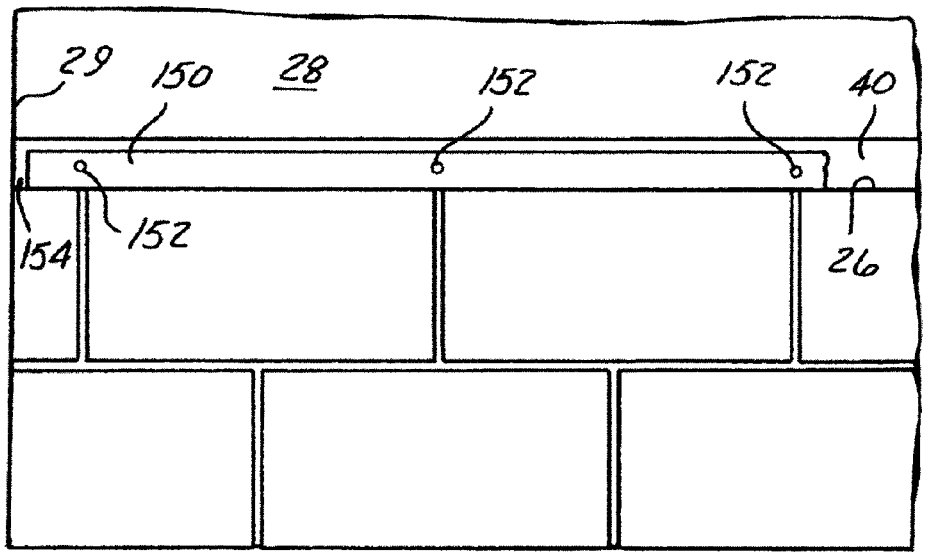
FIG. 11 illustrates the improved fiber cement or wood composite panel utilizing an installation method using a cement starter board strip.
Figure 12:
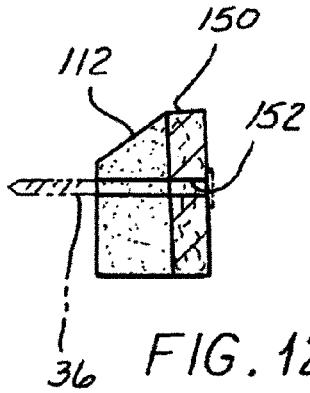
FIG. 12 is a sectional view of a starter board strip having a foam backer.

No special tools or equipment are required to install the new insulated fiber cement lap siding 100. However, a new starter adapter or strip 150 has been designed for use with this system, as shown in FIGS. 11 and 12. It is preferable to drill nail holes 152 through the adapter 150 prior to installation. The installer must first establish a chalk line 26 at the bottom of the wall 28 to serve as a straight reference line to position the starter adapter 150 for the first course of siding and follow the siding manufacturer's instructions.

The siding job can be started at either corner 29. The siding is placed on the starter adapter or strip 150 and seated fully and positioned, leaving a gap 154 of approximately ⅛ inches from the corner 29 of the building. Thereafter, the siding 100 is fastened per the siding manufacturer's installation recommendations using a nail gun or hammer to install the fasteners 36. Thereafter, a second course of siding 115' can be installed above the first course 115 by simply repeating the steps, as shown in FIG. 13. Where practical, it is preferable to fully install each course 115 before working up the wall, to help insure the best possible overall alignment. Installation in difficult and tight areas under and around windows, in gable ends, etc. is the same as the manufacturer's instruction of the current fiber cement lap siding 10.

The lamination methods and adhesive system will be the same as those outlined in U.S. Pat. Nos. 6,019,415 and 6,195,952B1.

The insulated fiber cement stack-on sliding panels 100 described above will have a composite thickness of approximately 1¼ inches. Depending on the siding profile, the composite siding 100 should offer a system "R" value of 3.5 to 4.0. This addition is dramatic when you consider that the average home constructed in the 1960's has an "R" value of 8. An "R-19" side wall is thought to be the optimum in energy efficiency. A building will be cooler in the summer and warmer in the winter with the use of the insulated fiber cement siding of the present invention.

In some particular aspects of the disclosure, the foam backing panel or foam insulation board includes an adhesive along one of the edges, which is useful for sealing the edges of adjacent backing panels or insulation boards to provide a uniform insulation layer with no cracks through which heat may be lost. The adhesive may be present on an entire edge or a portion thereof. For example, when the edges of the foam insulation board are arranged in a ship-lap configuration, one or all of the ship-lap surfaces may comprise the adhesive. In particular, the edge may have one or more faces on which the adhesive is present. More generally speaking, the horizontal and vertical edges of the insulation board are shaped to be complementary, which aids in joining them together and sealing any cracks between them.

In some particular aspects of the disclosure, the foam backing panel, whether made as a foam board or as a foam backer for a composite panel, is divided into an upper portion and a lower portion, the upper portion having a higher density than the lower portion of the foam backing panel. In this regard, a fastener, such as a nail or screw, is typically used to connect the foam backing panel to the exterior wall of the building being insulated. The fastener ultimately bears the weight of the entire siding. Damage can occur to the foam backing panel due to the heavy weight of some siding materials like fiber cement. Mechanical impacts to the siding or high wind conditions can also cause tearing or structural damage. The increased density of the upper portion, through which the fastener passes, reduces the damage that can occur to the foam insulating panel.

Figure 14:
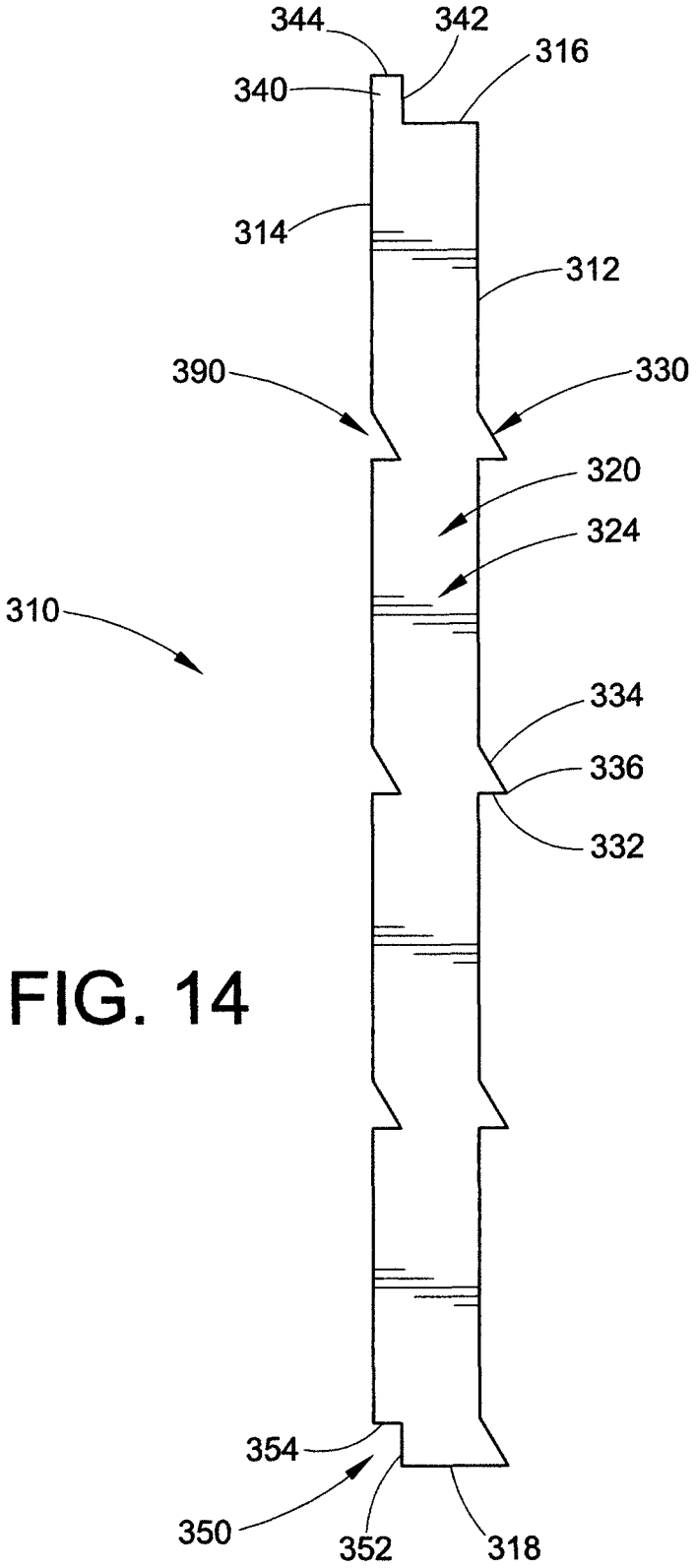
FIG. 14 is a left side view of another exemplary foam insulation board of the present disclosure.
Figure 15:
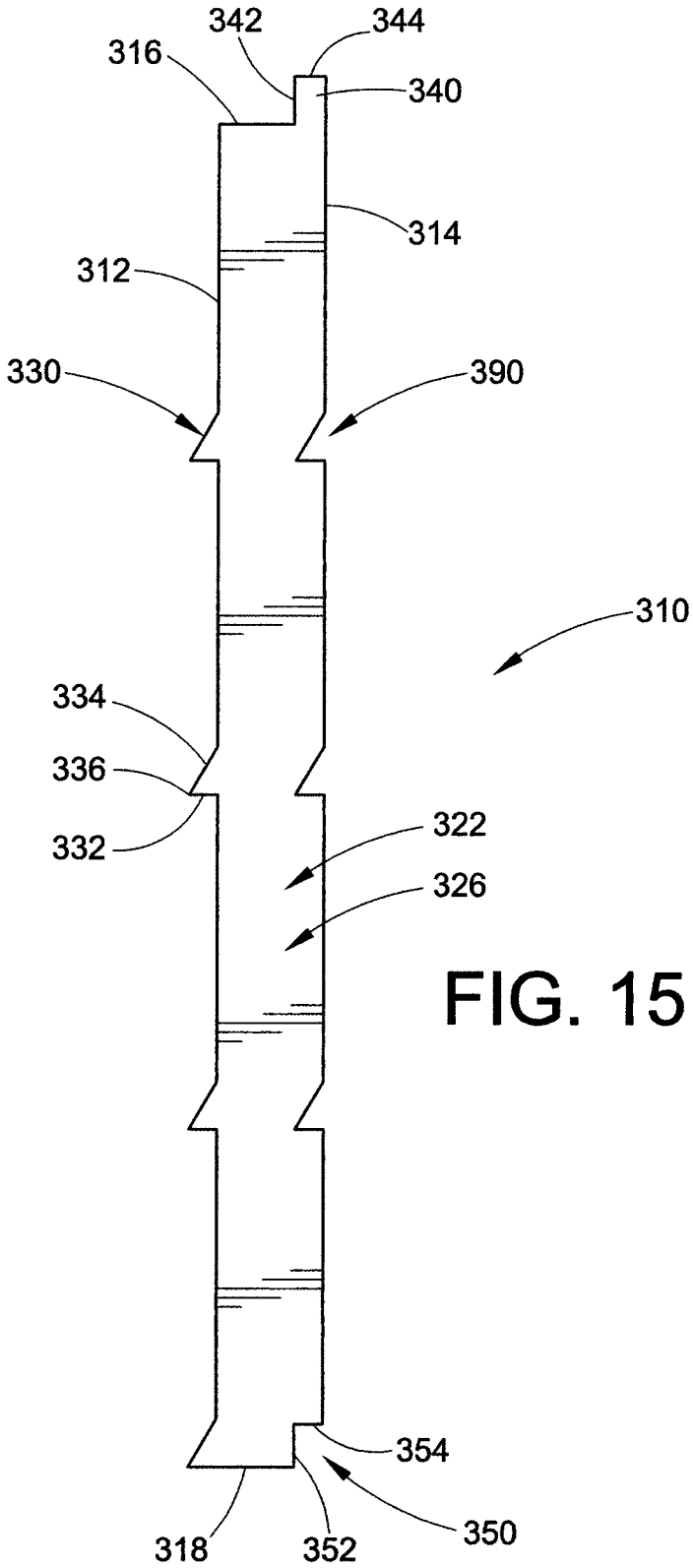
FIG. 15 is a right side view of the foam insulation board of FIG. 14.
Figure 16:
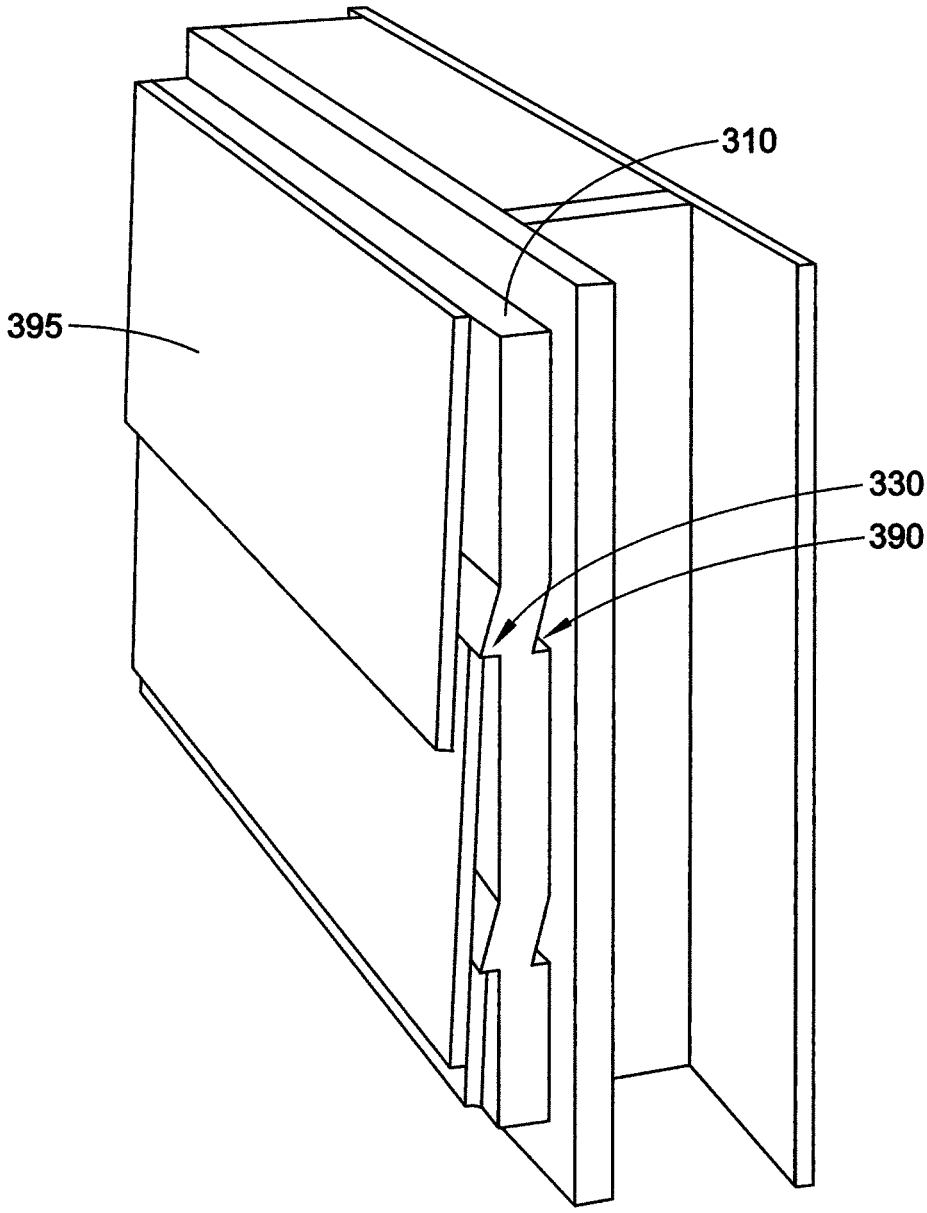
FIG. 16 is a perspective view of the foam insulation board of FIG. 14 with siding panels attached.
Figure 17:
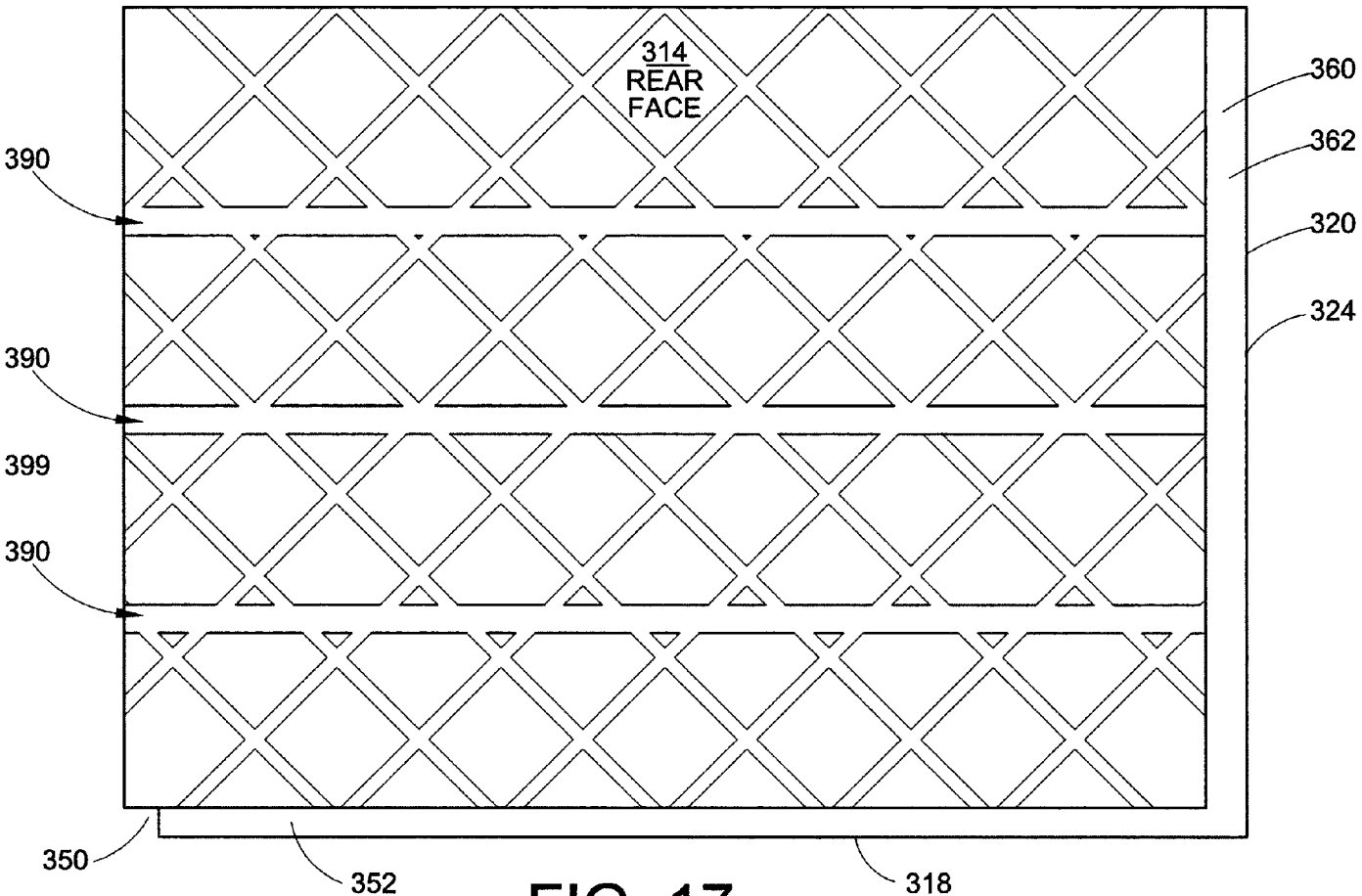
FIG. 17 is a rear view of the foam insulation board of FIG. 14.
Figure 18:
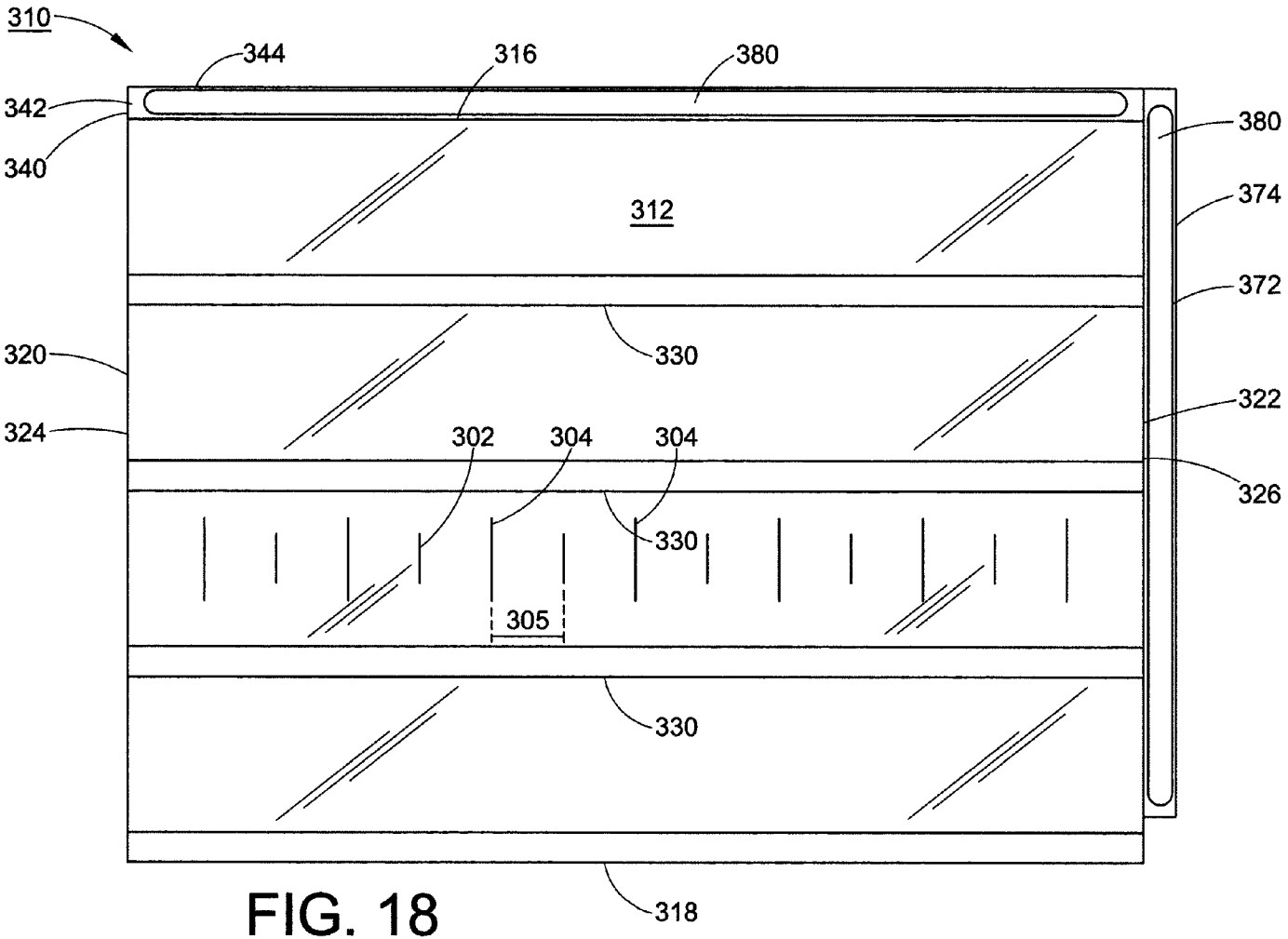
FIG. 18 is a front view of the foam insulation board of FIG. 14, also showing some optional features thereon.

FIGS. 14-18 show another exemplary embodiment of a foam insulation board that is designed to be used with siding panels. FIG. 14 is a left side view of the board. FIG. 15 is a right side view of the board. FIG. 16 is a perspective view of the foam insulation board attached to a wall, and with siding panels attached. FIG. 17 is a rear view of the board. FIG. 18 is a front view of the board with some optional features shown here. The foam board is attached to the exterior wall of the building being insulated, and siding panels (like those depicted in FIGS. 8B-8D) are attached to the foam board.

The foam board 310 has a front face 312, a rear face 314, a top face 316, a bottom face 318, a left side face 320, and a right side face 322. In this regard, the left side face 320 and the right side face 322 can also be considered as being a first side face 324 and a second side face 326. Here, the left side face 320 is labeled as being the first side face 324, and the right side face is labeled as the second side face 322. The top face 316 and the bottom face 318 may be considered to be horizontal faces of the foam board. The left side face 320 and the right side face 322 may be considered to be vertical faces of the foam board.

Referring to FIGS. 14-16, the front face 312 here is flat, i.e. the distance between the front face 312 and the rear face 314 is generally constant between the top face 316 and the bottom face 318. The front and rear faces are generally perpendicular to the top face and the bottom face. A plurality of registration ribs 330 extend from the front face 312 (i.e. forward and away from the rear face) and are positioned longitudinally across the front face of the foam board and run from one side face 320 of the board to the other side face 322, generally parallel to the top face 316 and the bottom face 318. The ribs are spaced equidistantly from each other. Please note that the intersection of the top face 316 and the bottom face 318 can also be considered a registration rib because when adjacent panels are stacked upon each other, they have the same aligning effect as a registration rib 330. Again, the foam board is generally designed to incorporate between four and twelve courses of siding. Siding panels (see FIG. 16) can be attached to the front face of the foam board. The top edge of each siding panel is abutted and positioned by a registration rib 330.

Each alignment or registration rib 330 includes a bottom face 332, a top sloped face 334, and a front edge 336, wherein the bottom face and the sloped top face meet at the front edge. The bottom face 332 of the registration rib is perpendicular with the front face 312 of the foam insulation board.

In some embodiments, the rear face has at least one recess 390 that is positioned longitudinally across the rear face 314 of the foam board and runs from one side face 320 of the board to the other side face 322, generally parallel to the top face 316 and the bottom face 318. If more than one recess is present, the recesses are spaced equidistantly from each other. The recesses 390 are complementary in shape to the registration ribs 330 and are positioned at the same level as each rib, as seen in FIG. 14 and FIG. 15. This permits the foam insulation to be efficiently stacked without damaging the registration ribs.

The top face 316 includes a top joining element 340. The bottom face 318 includes a bottom joining element 350. The top joining element 340 is complementary in shape to the bottom joining element 350, such that panels stacked upon each other are joined together in a shiplap arrangement to mate tightly together. Here, the top joining element 340 is shown as a tongue along the rear face of the foam board. The tongue includes a front face 342 that faces in the forward direction, and includes an upper face 344 that faces in an upward direction. The bottom joining element 350 is shown as a groove along the rear face of the foam board. The groove includes a rear face 352 that faces in the rearward direction, and includes a lower face 354 that faces in a downward direction. Put another way, the front face 342 of the top joining element is directed in the opposite direction of the rear face 352 of the second joining element. Similarly, the upper face 344 of the top joining element is directed in the opposite direction of the lower face 354 of the bottom joining element.

FIG. 16 is a perspective view, showing the foam insulation board 310 applied to a wall along with siding panels 395. Here, only two courses are shown. The registration ribs 330 and the recesses 390 are aligned with each other at the same level on the foam insulation board.

In some embodiments, joining elements are also present on the side. Referring now to FIG. 17 and FIG. 18, in such embodiments, the first side face 324 includes a first joining element 360. The second side face 326 includes a second joining element 370. The first joining element 360 is complementary in shape to the second joining element 370, such that panels arranged laterally to each other (i.e. side-by-side) are joined together in a shiplap arrangement to mate tightly together. Here, the second joining element 370 is shown as a tongue along the rear face of the foam board. The tongue includes a front face 372 that faces in the forward direction, and includes a sideward face that faces in a sideways direction (not visible). The first joining element 360 is shown as a groove along the rear face 314 of the foam board. The groove includes a rear face 362 that faces in the rearward direction, and includes a sideward face that faces in a sideways direction (not visible). Put another way, the sideward face of the first joining element is directed in the opposite direction of the sideward face of the second joining element. Similarly, the rear face 362 of the first joining element is directed in the opposite direction of the front face 372 of the second joining element. It should also be noted that some of the faces described herein overlap, especially at the corners of the foam board.

It should be noted that the first joining element 360 and the second joining element 370 may be as simple as the first side face 324 and the second side face 326 being parallel planes. There is no requirement that the first and second joining elements must be a structure that extends from or protrudes into the respective side face.

The rear view of FIG. 17 also shows the presence of drainage grooves 399 in the rear face. These drainage grooves are optional.

The front view of FIG. 18 also shows some other optional features. In certain embodiments, an adhesive is pre-applied to the foam insulation board during the manufacturing process, so that the siding installer does not have to laboriously apply such adhesive during the installation process. The adhesive may be present on any one or more of the edges/faces that overlap between panels. More specifically, the adhesive may be present on any one or combination of the following faces: the front face 342 of the top joining element; the upper face 344 of the top joining element; the rear face 352 of the bottom joining element; the lower face 354 of the bottom joining element; the front face 372 of the second joining element; the sideward face of the second joining element; the rear face 362 of the first joining element; the sideward face of the first joining element; the first side face 324, and the second side face 326. In some specific embodiments, adhesive is present only on the front face 342 of the top joining element. In other specific embodiments, adhesive is present on only one of the horizontal faces (i.e. either the top joining element 340 or the bottom joining element 350) and on only one of the vertical faces (i.e. either the first joining element 360 or the second joining element 370). As an example, adhesive 380 is shown in FIG. 18 as being present on the front face 342 of the top joining element and on the front face 372 of the second joining element 370.

The adhesive which is used on the sides/edges of the foam board may be used over the entire surface or used in discrete locations. Suitable adhesives may include, but are not limited to, UV curable adhesives and hot melt adhesives, such as polyamines and urethanes, glue, thermosetting or thermoplastic adhesives, pressure sensitive adhesives or solvent-based adhesives. Desirably, the adhesive is a pressure sensitive adhesive, which forms a bond upon application of light pressure.

In particular embodiments, the foam board is packaged with the adhesive covered up with a pull-off strip.

Another especially desirable feature which may be present on any embodiment of the foam insulation boards discussed herein is a plurality or series of relative distance markers or indicators. Such relative distance markers 302 are visible on the embodiment seen in FIG. 18. In this regards, there is a constant distance 305 between adjacent markers. Put another way, the relative distance markers 302 are positioned longitudinally across the front face of the foam insulation board and are spaced equidistantly. These distance markers are helpful to installers because the foam insulation board is typically fastened (e.g. nailed) to the wall studs (vertical members) in the building. In North America, studs are typically placed at regular intervals of 12, 16, or 24 inches. The relative distance markers 302 allow the installer to quickly locate additional wall studs once the location of the first wall stud has been determined. The relative distance markers are generally carved into the front face. As illustrated here, the relative distance markers are simply straight lines. There are two sets of straight lines here. For example, there can be a distance of four inches between each marker, and a distance of eight inches between the markers labeled with reference numeral 304. It is contemplated that there could be two different sets of relative distance markers having different intervals as well, with each set being indicated by a different color. For example, one set of relative distance markers would have a distance of 12 inches between adjacent markers and be red lines, while the other set of relative distance markers would have a distance of 16 inches between adjacent markers and be green lines. The relative distance markers are hidden by the siding panels (not shown) when installation is completed.

The foam insulation board and the adhesive can be made and used with the common knowledge of one of ordinary skill in the art.

As will be appreciated, during the installation of the foam insulation backer boards or composite panels set forth herein, the first (e.g., bottom) course should be level because the alignment of subsequent courses (above the first course) can be affected by a misaligned first course. A starter strip can be installed at a bottom edge of a wall to simplify installation, making it easier for an installer to keep the first course of panels level and on the same plane.

In some other particular aspects of the disclosure, the foam insulation backing board can be divided into an upper portion and a lower portion, the upper portion having a higher density than the lower portion of the foam backing panel. In this regard, a fastener, such as a nail or screw, is typically used to connect the foam backing panel to the exterior wall of the building being insulated. The fastener ultimately bears the weight of the entire siding. Damage can occur to the foam backing panel due to the heavy weight of some siding materials like fiber cement. Mechanical impacts to the siding or high wind conditions can also cause tearing or structural damage. The increased density of the upper portion, through which the fastener passes, reduces the damage that can occur to the foam insulating panel.

Figure 19:
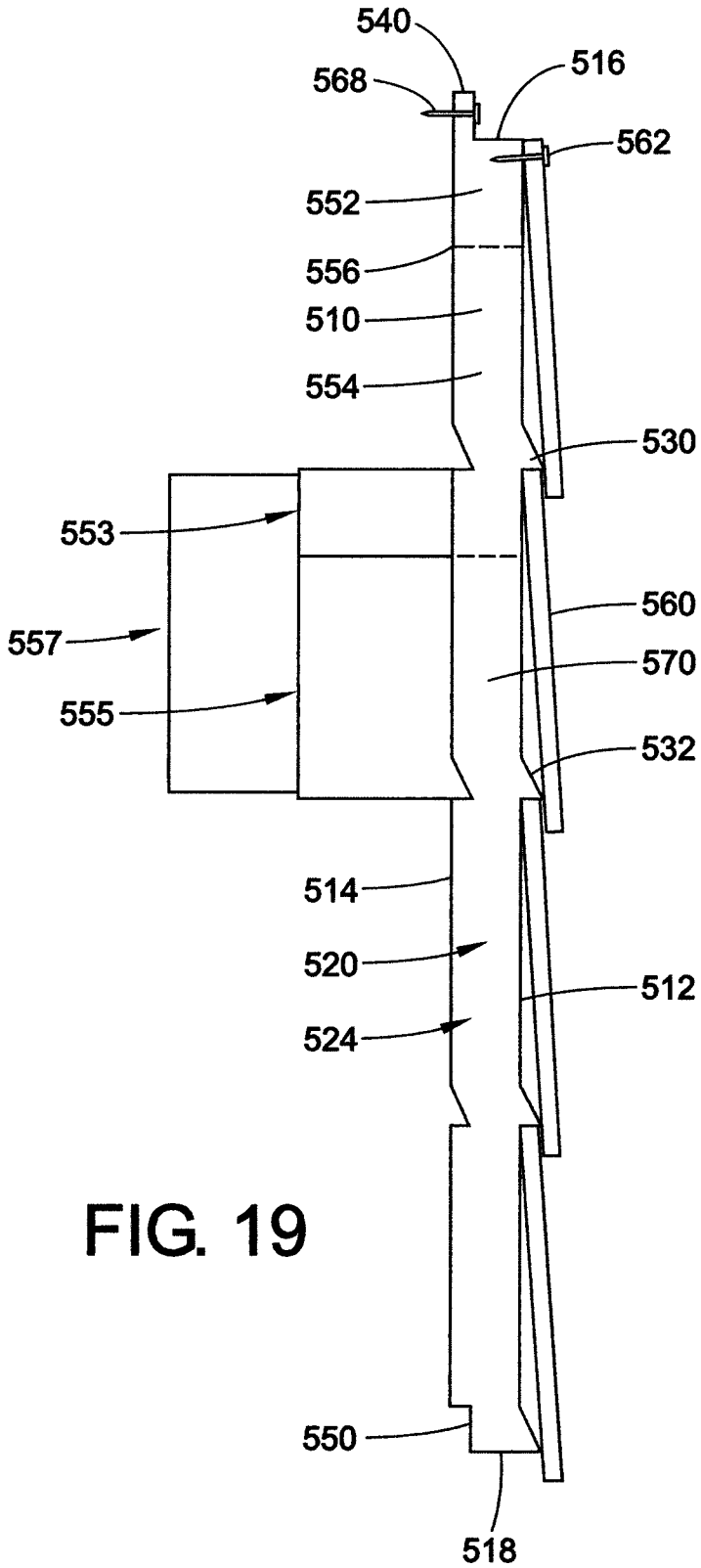
FIG. 19 is a side view of the foam installation board with an additional option of dual density portions.
Figure 20:
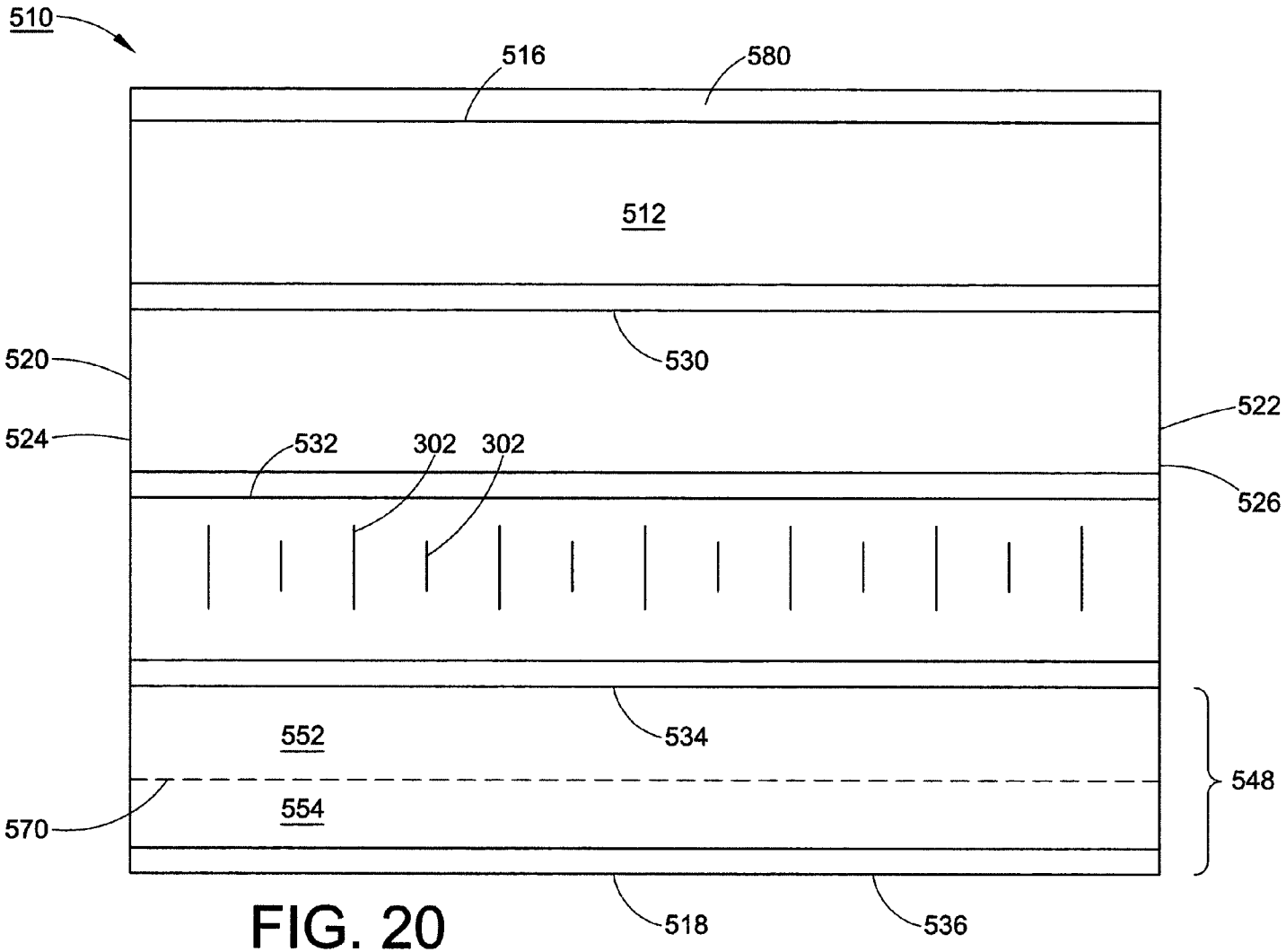
FIG. 20 is a front view of the foam insulation board of FIG. 19.

FIG. 19 is a side view of an exemplary embodiment 500 that uses a foam board 510 and a plurality of siding panels 560. FIG. 20 is a front view of the foam board 510 only. The foam board is attached to the exterior wall of the building being insulated, and the siding panels are attached to the foam board. The foam board 510 has a front face 512, a rear face 514, a top face 516, a bottom face 518, a left side face 520, and a right side face 522. In this regard, the left side face 520 and the right side face 522 can also be considered as being a first side face 524 and a second side face 526. Here, the left side face 520 is labeled as being the first side face 524, and the right side face is labeled as the second side face 522. The top face 516 and the bottom face 518 may be considered to be horizontal faces of the foam board. The left side face 520 and the right side face 522 may be considered to be vertical faces of the foam board.

The front face 512 here is shown to be flat, i.e. the distance between the front face 512 and the rear face 514 is generally constant between the top face 516 and the bottom face 518. The top face 516 includes a first joining element 540, and the bottom face 518 includes a second joining element 550. The first joining element 540 is complementary in shape to the second joining element 550, such that panels stacked upon each other are joined together in a shiplap arrangement to mate tightly together. Here, the first joining element 540 is shown as a tongue along the rear face of the foam board, and the second joining element 550 is shown as a groove along the rear face of the foam board.

A plurality of registration ribs 530 are positioned longitudinally across the front face of the foam board and run from one side of the board to the other side, generally parallel to the top face 516 and the bottom face 518. The ribs are spaced equidistantly from each other. Again, the foam board is generally designed to incorporate between four and twelve courses of siding.

Each course is defined by a pair of registration or alignment ribs. Put another way, a course is defined between adjacent registration ribs. For example, course 570 is defined by ribs 530 and 532. Please note that the top face 516 and bottom face 518 should also be considered as a registration rib because when adjacent panels are stacked upon each other, they have the same effect as the ribs 530. Each course is also separated into a high density portion or upper portion 552 and a low density portion or lower portion 554. The high density portion 552 and the low density portion 554 are separated here by the line having reference numeral 556. The high density portion 552 is located above the low density portion 554 in each course. The high density portion 552 and the low density portion 554 both run from the front face 512 to the rear face 514. Again, the high density portion 552 has a height 553 and the low density portion 554 has a height 555, measured on the rear face 514 of the foam board. The height 557 of each course is the sum of the two heights 553 and 555. Generally speaking, there is no "middle" portion between the high density portion and the low density portion, although there may be a thin layer between the two portions where the density changes rapidly. Generally, the high density portion of each course has the same density, and the low density portion of each course has the same density. Put another way, the foam board 510 can be described as having alternating high density portions 552 and low density portions 554 between the top face 516 and the bottom face 518.

A siding panel 560 is aligned with each course and attached using a fastener 562 which passes through the high density portion 552 of each course. Again, this increases the stability of the foam board 510. The top edge of each siding panel is abutted and positioned by a registration rib 530.

In addition, the foam board 510 itself might be attached to the exterior wall 501 separately from the siding panels 560. In such embodiments, the portion of the foam board through which the fastener 568 passes should also be of high density. Thus, as depicted here, the first joining element 540 which rises above the top face 516 is also of high density. Put another way, the density of the first joining element is greater than the density of the low density portion of each course. In yet more specific embodiments, the density of the first joining element is equal to or greater than the density of the high density portion of each course.

It is contemplated that the foam insulation board contains a visual indicator that permits the installer to distinguish between the high density portion 552 and the low density portion 554. For example, as illustrated in FIG. 20 and course 548, a dotted line 570 indicates the demarcation between high density and low density. If desired, a letter "H" may be placed in the high density portion and a letter "L" may be placed in the low density portion. Alternatively, each portion can have a different color. The visual indicators are hidden by the siding panel 560 when installation is completed.

The ratio of the height of the high density portion to the height of the low density portion may be from about 2:1 to about 1:3, or more specifically from about 1:1 to about 3:2.

The high density portion may have a density of from about 200 to about 640 g/cm$^3$, or more specifically from about 250 to about 500 g/cm$^3$. The low density portion may have a density of from about 16 to about 350 g/cm$^3$, or more specifically from about 20 to about 200 g/cm$^3$. The high density portion is of course always denser than the low density portion. However, it should be noted that the difference in density between the high density portion and the low density portion is generally at least 50 g/cm$^3$.

The foam insulation board of FIG. 14 may include additional features not shown. For example, the opposing vertical sides of the foam board may include the interlocking tab and slot arrangement illustrated in FIG. 2A. It is contemplated that any of the siding panels shown in FIGS. 8B-8D could be used with the foam board of FIG. 15.

While the invention has been described in connection with what is presently considered to be the most practical and preferred embodiment, it is to be understood that the fiber cement siding board disclosed in the invention can be substituted with the aforementioned disclosed materials and is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A foam insulation backing board, comprising:

a front face, a rear face, a bottom face, and a top face, a first side face, and a second side face;

wherein the front face has at least one alignment rib positioned longitudinally across the front face and running from the first side face to the second side face, and extending from the front face;

the alignment rib comprising a bottom face, a sloped top face, and a front edge, wherein the bottom face and the sloped top face meet at the front edge; and wherein the rear face has at least one recess positioned longitudinally across the rear face, wherein the recess in the rear face and the alignment rib are complementary in shape and are positioned opposite and parallel to each other at the same level;

wherein the bottom face of each alignment rib is perpendicular to the front face of the foam insulation backing board.

2. The foam insulation backing board of claim 1, wherein the front face and the rear face are parallel such that the foam insulation backing board has a constant thickness from the top face to the bottom face of the foam insulation backing board; and wherein the foam insulation backing board has a thickness between ¼ inch and 4 inches when measured from the front face to the rear face.

3. The foam insulation backing board of claim 1, wherein the rear face of the foam insulation backing board includes a water management means for directing water.

4. The foam insulation backing board of claim 3, wherein the water management means comprises diagonal grooves.

5. The foam insulation backing board of claim 1, wherein the first side face includes a first joining element and the second side face includes a second joining element complementary in shape to the first joining element.

6. The foam insulation backing board of claim 5, wherein the first joining element of the first side face is a tab and the second joining element of the second side face is a groove and is complementary to the tab.

7. The foam insulation backing board of claim 1, wherein the top face includes a top joining element and the bottom face includes a bottom joining element complementary in shape to the top joining element.

8. The foam insulation backing board of claim 7, wherein the top joining element of the top face is a tab and the bottom joining element of the bottom face is a groove and is complementary to the tab.

9. The foam insulation backing board of claim 1, wherein the foam insulation backing board is made of expanded polystyrene.

10. An insulation system, comprising:

an insulating foam backing board comprising;

a front face, a rear face, a bottom face, a top face, a first side face, and a second side face;

wherein the front face has at least one alignment rib positioned longitudinally across the front face and running from the first side face to the second side face, and extending from the front face;

the alignment rib comprising a bottom face, a sloped top face, and a front edge, wherein the bottom face and the sloped top face meet at the front edge; and a plurality of siding panels, each siding panel comprising a front face, rear face, top face and bottom face wherein the bottom face of each alignment rib is perpendicular to the front face of the foam insulation backing board.

11. The insulation system of claim 10, wherein the rear face has at least one recess positioned longitudinally across the rear face at the same level as the at least one alignment rib, and wherein the recess in the rear face and the alignment rib are complementary in shape.

12. The insulation system of claim 10, wherein the top face of each siding panel is aligned with the bottom face of an upper alignment rib and the rear face of the siding panel rests on the front edge of a lower alignment rib.

13. The insulation system of claim 12, wherein the bottom face of the siding panel extends below the bottom face of the lower alignment rib.

14. The insulation system of claim 12, wherein the siding panels are a fiber cement or composite wood material.

* * * * *